United States Patent [19]

Schniter

[11] Patent Number: 4,872,797

[45] Date of Patent: Oct. 10, 1989

[54] BOOK OPENING APPARATUS

[75] Inventor: Jorg Schniter, Glenview, Ill.

[73] Assignee: R.R. Donnelley & Sons Company, Chicago, Ill.

[21] Appl. No.: 278,498

[22] Filed: Dec. 1, 1988

[51] Int. Cl.[4] ..... B42C 5/00

[52] U.S. Cl. ..... 412/25; 412/33; 412/36

[58] Field of Search ..... 412/25, 33, 36; 281/42; 271/265, 272, 189

[56] References Cited

FOREIGN PATENT DOCUMENTS 131443 1/1985 European Pat. Off. ..... 412/25

*Primary Examiner*—Paul A. Bell
*Assistant Examiner*—Thomas Hamill, Jr.
*Attorney, Agent, or Firm*—Wood, Dalton, Phillips, Mason & Rowe

[57] ABSTRACT

An apparatus for opening a book having a plurality of pages held in assembled relation with adjacent foredges substantially in contact with one another. The apparatus includes a rotatable pin for initiating separation of pages of the book by contacting and entering the book at one end of the adjacent foredges to thereby cause one of the pages to be separated from a next adjacent of the pages at a selected location in the book. Additionally, at a ribbon inserting station, a ribbon inserter can be provided to insert a ribbon into the selected location in the book between the one of the pages and the next adjacent of the pages. The apparatus may also include a knife assembly downstream of the rotatable pin which is adapted to maintain separation of the pages upon entering the book at the selected location for any purpose such as accommodating insertion of a ribbon by the ribbon inserter. With this arrangement, the book opening apparatus is well suited for opening a book without damage to the pages thereof.

20 Claims, 2 Drawing Sheets

BOOK OPENING APPARATUS

FIELD OF THE INVENTION

The present invention generally relates to ribbon inserting devices and, more particularly, to an apparatus for opening a book without damage to the pages thereof.

BACKGROUND OF THE INVENTION

In a book binding process, there are certain applications where it is known to be desirable to open a book for various reasons such as inserting a ribbon, e.g., as a book mark. This is commonly done, for instance, in high quality hard bound books that are frequently read, openly displayed and often cherished by those who own them such as the Bible, complete unabridged versions of the dictionary, encyclopedias, and other important reference sources. For such books, a ribbon not only serves as a book mark but also adds to the overall perceived quality of the book.

In addition, books of this type frequently are bound with pages that have a special treatment on the outer edges thereof. This may include by way of example a gold leaf treatment which adds to the beauty of the book and encourages its display in a highly visible location in a home, office or the like. Frequently, books of this type have pages with rounded corners to further enhance its overall appearance.

In the past, it has been found most difficult to open round cornered books in automated binding lines in a manner not damaging the pages thereof. A sharp knife edge which can be used with some success for square cornered books will typically produce blemishes or otherwise damage round cornered books which thereby detracts from the appearance of the finished book, but this has been the only known practical automated method of opening a book for purposes such as insertion of a ribbon for applications where a ribbon is desired. Where a publisher desires to open the book at a selected location, the pages must be tightly held in assembled relation making it even more likely that the sharp knife will damage the pages.

Typically, publishers do wish to pinpoint with some accuracy the placement of a ribbon at a selected location in the book. It is possible to avoid damage to the pages caused by the use of a sharp knife edge or the use of a spear in certain applications (both of which produce blemishes) by holding the book loosely and using air to separate the pages. However, this procedure avoids the problem of producing a blemish at the expense of failing to place the ribbon at a selected location.

The present invention is directed to overcoming these problems and accomplishing the resulting objects by providing a unique ne book opening apparatus.

SUMMARY OF THE INVENTION

Accordingly, the present invention is directed to an apparatus for opening a book having a plurality of pages held in assembled relation with adjacent foredges substantially in contact with on another. The apparatus includes rotatable means for initiating separation of pages of the book by contacting and entering the book at one end of the adjacent foredges to thereby cause one of the pages to be separated from a next adjacent of the pages at a selected location in the book. Additionally, a book ribbon inserting apparatus may include means for inserting a ribbon into the selected location in the book between the one of the pages and the next adjacent of the pages.

Preferably, the apparatus includes means for holding the pages in assembled relation as the rotatable means contacts and enters the book at the selected location. It is also advantageous in the preferred embodiment for the rotatable means to comprise an elongated page separating pin disposed at an acute angle to a plane generally defined by the adjacent foredges of the pages, e.g., an angle of approximately 45 degrees. With this arrangement, the elongated page separating pin preferably points generally away from the book as it first contacts and enters the book.

In the preferred embodiment, non-rotatable means is provided to maintain separation of the pages at the selected location in the book. The non-rotatable means serves this function to accommodate, e.g., insertion of a ribbon by the ribbon inserting means and preferably comprises a knife assembly adapted to maintain separation of the pages upon entering the book. Preferably, the knife assembly has a leading edge disposed at an acute angle, e.g., approximately 45 degrees, to a plane generally defined by the adjacent foredges of the pages.

In a binding process, the apparatus is adapted for inserting a ribbon in each of a plurality of books each having a plurality of pages. The apparatus then includes means for delivering the books one at a time from a supply thereof to a ribbon inserting station where the ribbon is inserted, and thereafter moving the books away from the ribbon inserting station. At the ribbon inserting station, means is provided for holding the pages of each of the books in assembled relation as they are moved by the delivering means.

In a most preferred embodiment, the holding means, or guide means, includes parallel guide rails at the ribbon inserting station adapted to engage opposite sides of the book to maintain the pages in assembled relation. It is also highly advantageous for the guide means to include compression rollers at the ribbon inserting station adapted to engage opposite sides of the book. With this arrangement, the elongated page separating pin can separate pages of the book by causing one of the pages to be rolled away from the next adjacent of the pages.

Still other objects, advantages and features of the present invention will become apparent from a consideration of the following description taken in conjunction with the accompanying drawings.

DETAILED DESCRIPTION OF THE PREFERRED EMBODIMENT

Figure 1:
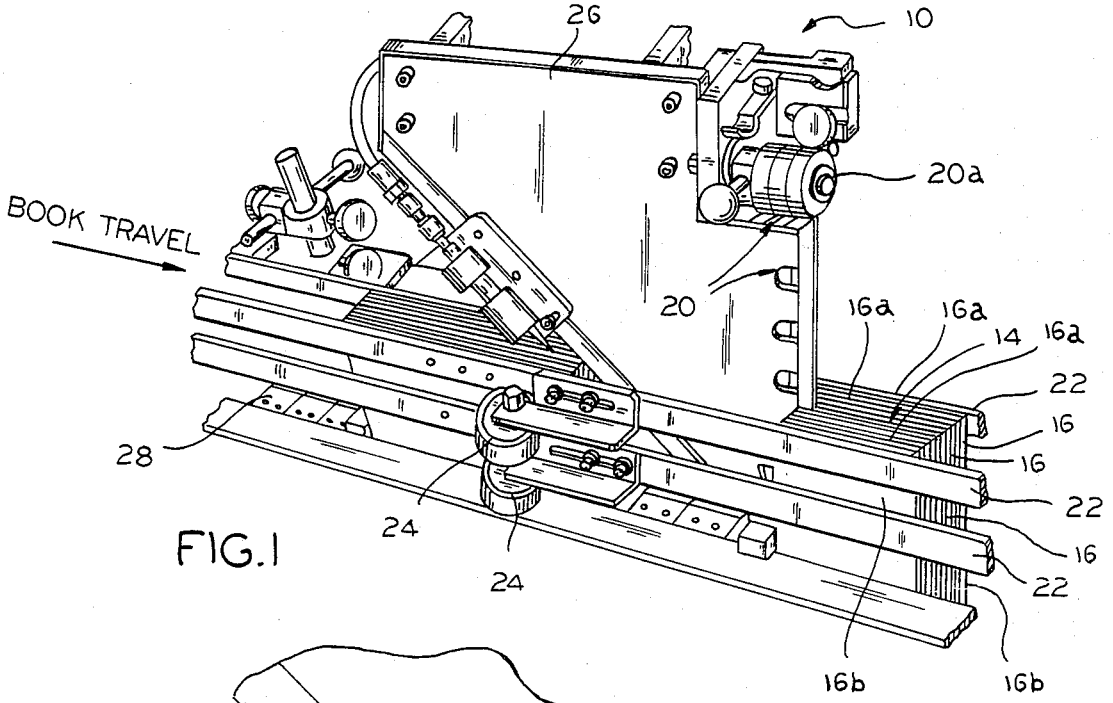
FIG. 1 is a perspective view of a book opening and ribbon inserting apparatus in accordance with the present invention.
Figures 3, 4, 5:
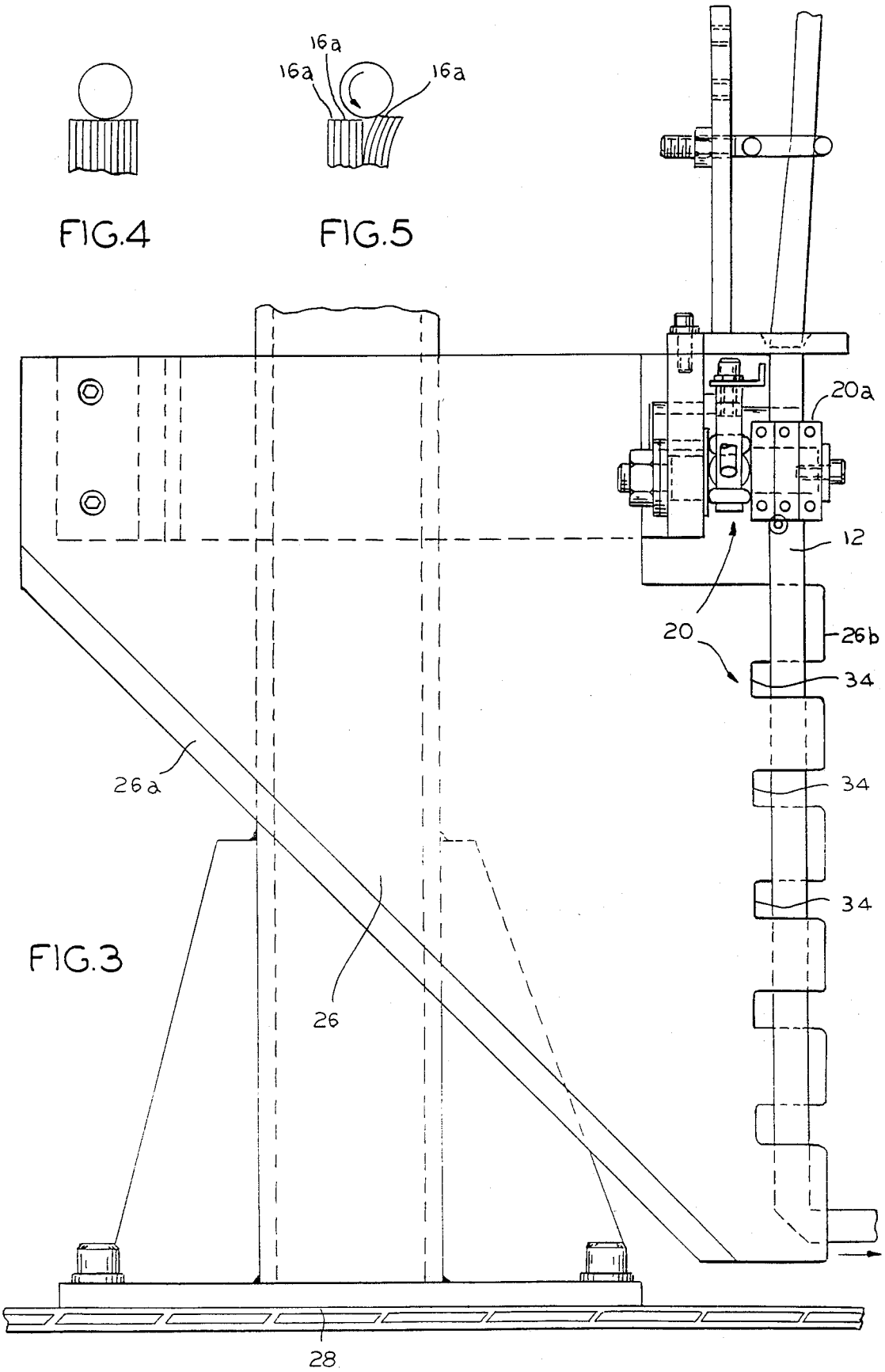
FIG. 3 is an enlarged side elevational view, with a portion removed, of the apparatus illustrated in FIG. 1.
FIG. 4 is a schematic illustration of a rotating pin contacting a corner of a book.
FIG. 5 is a schematic illustration of a rotating pin initiating separation of pages of a book.

Referring to the drawings, and first to FIGS. 1, 3 and 5, the reference numeral 10 designates generally an apparatus for inserting a ribbon 12 in a book 14 having a plurality of pages 16 held in assembled relation with adjacent foredges 16a substantially in contact with one another. The apparatus 10 includes rotatable means such as an elongated page separating pin 18 for initiating separation of pages 16 of the book 14 by contacting and entering the book at one end of the adjacent foredges 16a to thereby cause one of the pages 16 to be separated from a next adjacent of the pages 16 at a selected location in the book. With this arrangement, and referring specifically to FIG. 3, the book ribbon inserting apparatus 10 also includes means generally designated 20 for inserting and calipering the ribbon 12 into the selected location in the book 14 between the one of the pages 16 and the next adjacent of the pages 16.

As shown in both FIGS. 1 and 3, the ribbon inserting and calipering means 20 includes a caliper 20a. The purpose of the caliper 20a is to detect a splice, an absence of ribbon, a missing double ribbon when two ribbon thicknesses are required, etc. As for the remainder of the ribbon inserting and calipering means 20, it will be appreciated that the books 14 pull the ribbon by friction in the direction of travel (see FIG. 3), i.e., there is no other ribbon propulsion mechanism.

In the illustrated embodiment, the book ribbon inserting apparatus 10 also includes means for holding the pages 16 in assembled relation as the elongated page separating pin 18 contacts and enters the book 14 at the selected location. Preferably, the holding means, or guide means, comprises parallel guide rails 22 at a ribbon inserting station where the book ribbon inserting apparatus 10 is positioned. As will be appreciated, the guide rails 22 are adapted to engage opposite side 16b of the book 14 to maintain the pages 16 in assembled relation which is also assisted by the compression rollers 24.

Figure 2:
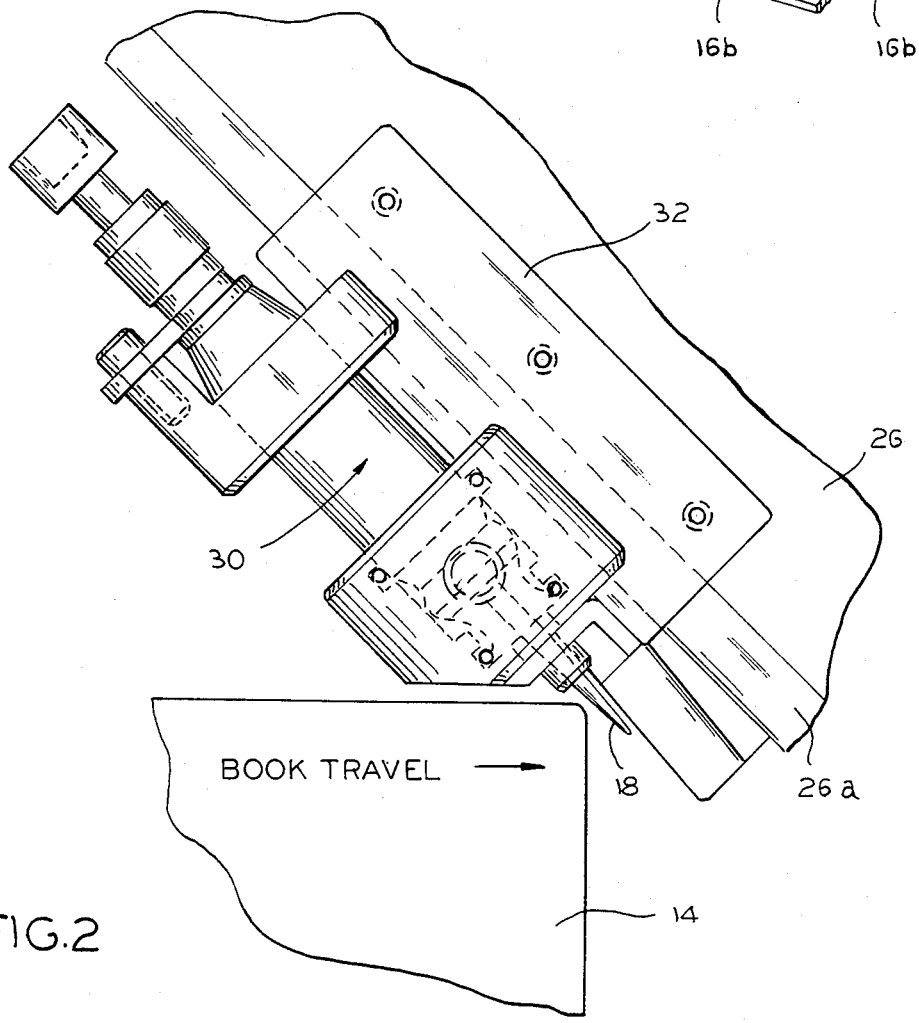
FIG. 2 is an enlarged side elevational view of a portion of the apparatus illustrated in FIG. 1.

As shown, the elongated page separating pin 18 is disposed at an acute angle, e.g., approximately 45 degrees, to a plane generally defined by the adjacent foredges 16a of the pages 16. It will be noted that the pin 18 points generally away from the book 14 as the pin 18 first contacts and enters the book at the selected location (see FIG. 2). As the elongated page separating pin 18 contacts and enters the book 14 as shown in FIGS. 4 and 5, it causes one of the pages 16 to be rolled away from a next adjacent of the pages 16 at the selected location in the book.

In the illustrated embodiment, the book ribbon inserting apparatus 10 further includes non-rotatable means such as the knife assembly 26 for maintaining separation of the pages 16 at the selected location in the book 14 to accommodate insertion of the ribbon 12 by the ribbon inserting and calipering means 20 at the selected location in the book 14. It maintains separation upon entering the book 14 at the selected location, as will be understood by referring to FIGS. 1 and 2, and has a leading edge 26a disposed at an acute angle, e.g., approximately 45 degrees, to the plane generally defined by the adjacent foredges 16a of the pages 16. Still more particularly, the knife assembly 26 is formed such that the leading edge 26a extends downwardly away from the book 14 when viewed as the knife assembly 26 first contacts and enters the book 14 after the elongated page separating pin 18 has entered the book 14 at the selected location.

In a binding process, the apparatus 10 is adapted for inserting a ribbon 12 in each of a plurality of books 14 each having a plurality of pages 16. Advantageously, a conveyor 28 is provided for delivering the books 14 one at a time from a supply thereof (not shown) to the ribbon inserting station for insertion of the ribbon 12 and the conveyor 28 thereafter moves the book 14 away from the ribbon inserting station. In this manner, the book ribbon inserting apparatus 10 allows insertion of ribbons 12 into books 14, a process formerly done by hand, at a line speed of approximately 100 books per minute.

As will be appreciated, the page separating pin 18 is disposed forwardly of the leading edge 26a of the knife assembly 26 in closely spaced parallel relation. This allows the pin 18 to cause one of the pages 16 to be rolled away from a next adjacent of the pages 16, much in the manner of leafing through a book, to initiate page separation at the selected location in the book. As will also be appreciated from FIGS. 1 and 3, the ribbon inserting and calipering means 20 is disposed at a point rearwardly of the leading edge 26a of the knife assembly 26.

In the embodiment illustrated, the elongated page separating pin 18 is carried by an air motor 30. The pin 18 could, by way of example and not limitation, comprise a thin polished needle driven by the air motor 30 and formed of a material such as nylon, Teflon, or any other material capable of giving the pin a smooth, polished, slick surface. Also, while an air motor 30 has been illustrated, the pin 18 could be driven by an electric motor, flexible shaft, etc.

As for the speed of rotation of the pin 18, it is not believed to be critical. It has been found in practice that the pin 18 need have just enough torque to cause the pages to roll as illustrated in FIG. 5 while not enough speed to burn the pages. Of course, this is a matter that will depend on the composition of the pages, pin, etc.

As illustrated in the drawings, the air motor 30 is supported by means of an integral mounting bracket 3 which is secured in a conventional manner to the leading edge 26a of the knife assembly 26. It can, if desired, be slidably secured to the leading edge 26a of the knife assembly 26 to accommodate different size books 14 in a manner that will be readily apparent to those skilled in the art. In any event, the air motor 30 is mounted by means of the mounting bracket 32 in such a manner that the pin 18 extends in closely spaced parallel relation to the leading edge 26a of the knife assembly 26.

As for the ribbon inserting and calipering means 20, it is a conventional device adapted to dispense ribbon for insertion into a book. It will be seen that the ribbon 12 extends from the caliper 20a through a series of notches 34 in a rear vertical edge 26b of the knife assembly 26 in alternating, threaded fashion therethrough. Since the exact nature of the ribbon inserting and calipering means 20 is not critical to the invention, it has not been described in detail herein.

While in the foregoing there has been set forth a preferred embodiment of the invention, it is to be understood that the invention is only to be limited by the spirit and scope of the appended claims.

I claim:

1. An apparatus for opening a book at a preselected location in the book, the book having a plurality of pages held in assembled relation with adjacent foredges substantially in contact with one another, the apparatus comprising:

means for delivering the book to an opening station, said delivering means being adapted to move the book from a supply station to the opening station and thereafter away from said opening station;

means at said opening station for holding the pages of the book in assembled relation as the book is moved by said delivering means; and rotatable means at said opening station for initiating separation of the pages of the book by contacting and entering the book at one end of the adjacent foredges of the pages, said rotatable means causing one of the pages to be separated from the next adjacent page at said preselected location in the book,

2. The book opening apparatus of claim 1 wherein aid rotatable means comprises an elongated page separating pin disposed at an acute angle to a plane generally defined by the adjacent foredges of the pages.

3. The book opening apparatus of claim 2 wherein the acute angle between said page separating pin and the plane of the foredges is approximately forty five degrees, said pin pointing generally away from the book as said rotatable means first contacts and enters the book at said preselected location.

4. The book opening apparatus as defined in claim 1 including non-rotatable means for maintaining separation of the pages at said preselected location in the book, said non-rotatable means being positioned downstream of said rotatable means to maintain separation of the pages at said preselected location in the book.

5. The book opening inserting apparatus as defined in claim 4 wherein said non-rotatable means comprises a knife assembly adapted to maintain separation of the pages upon entering the book at said preselected location, said knife assembly having a leading edge disposed at an acute angle to a plane generally defined by the adjacent foredges or the pages.

6. An apparatus for inserting a ribbon in each of a plurality of books each having a plurality of pages, the apparatus comprising:

means for delivering books one at a time to a ribbon inserting station, said delivering means being adapted to move the books from a supply thereof for insertion of a ribbon, said delivering means thereafter moving the books away from said ribbon inserting station;

means at said ribbon inserting station for holding the pages of each of the books in assembled relation as the books are moved by said delivering means;

rotatable means at said ribbon inserting station for initiating separation of pages of the book by contacting and entering the book at one end of adjacent foredges of the pages, said rotatable means causing one of the pages to be separated from a next adjacent of the pages at a selected location in the book; and means at said ribbon inserting station for inserting a ribbon into the book at said selected location between one of the pages and the next adjacent of the pages.

7. The ribbon inserting apparatus as defined in claim 6 wherein said rotatable means comprises an elongated page separating pin disposed at an acute angle to a plane generally defined by the adjacent foredges of the pages.

8. The ribbon inserting apparatus as defined in claim 7 wherein acute angle between said page separating pin and the plane of the foredges is substantially forty five degrees, said pin pointing generally away from the book as said rotatable means first contacts and enters the book said selected location.

9. The ribbon inserting apparatus as defined in claim 8 including non-rotatable means for maintaining separation of the pages at said selected location in the book, said non-rotatable means maintaining separation of the pages to accommodate insertion of the ribbon by said ribbon inserting means at said selected location in the book.

10. The ribbon inserting apparatus as defined in claim 9 wherein said non-rotatable means comprises a knife assembly adapted to maintain separation of the pages upon entering the book at said selected location said knife assembly having a leading edge disposed at an acute angle to a plane generally defined by the adjacent foredges of the pages.

11. The ribbon inserting apparatus as defined in claim 10 wherein the acute angle between the leading edge and the plane of the foredges is approximately forty five degrees, the leading edge extending downwardly away from the book as said knife assembly first contacts and enters the book at said selected location.

12. An apparatus for inserting a ribbon in each of a plurality of books each having a plurality of pages, the apparatus comprising:

a conveyor for delivering books one at a time to a ribbon inserting station said conveyor being adapted to move the books from a supply thereof for insertion of a ribbon at said ribbon inserting station, said conveyor thereafter moving the books away from said ribbon inserting station;

guide means for maintaining the pages of each of the books in assembled relation as the books are moved by said conveyor:

rotatable means at said ribbon inserting station for initiating separation of pages of the book by contacting and entering the book at one end of adjacent foredges of the pages, said rotatable means initiating separation of the pages by causing one of the pages to be rolled away from adjacent of the pages at a selected location in the book;

non-rotatable means at said ribbon inserting station for maintaining separation of the pages at said selected location in the book; and means at said ribbon inserting station for inserting a ribbon into said selected location in the book between the one of the pages and the next adjacent of the pages;

said non-rotatable means maintaining separation of the pages to accommodate insertion of the ribbon by said ribbon inserting means at said selected location in the book.

13. The ribbon inserting apparatus as defined in claim 12 wherein said guide means includes parallel guide rails at said ribbon inserting station adapted to engage opposite sides of the book to maintain the pages in assembled relation.

14. The ribbon inserting apparatus as defined in claim 12 wherein said guide means includes compression rollers at said ribbon inserting station adapted to engage opposite sides of the book to maintain said pages in assembled relation.

15. The ribbon inserting apparatus as defined in claim 12 wherein said rotatable means comprises an elongated page separating pin disposed at an acute angle to a plane generally defined by the adjacent foredges of the pages.

16. The ribbon inserting apparatus as defined in claim 15 wherein said non-rotatable means comprises a knife assembly adapted to maintain separation of the pages upon entering the book at said selected location, said knife assembly having a leading edge disposed at an acute angle to a plane generally defined by the adjacent foredges of the pages.

17. The ribbon inserting apparatus as defined in claim 16 wherein said page separating pin is disposed forwardly of said leading edge of said knife assembly in closely spaced parallel relation.

18. The ribbon inserting apparatus as defined in claim 15 wherein the acute angle between said page separating pin and the plane of the foredges is approximately forty five degrees, said pin pointing generally away from the book as the rotatable means first contacts and enters the book at said selected location.

19. The ribbon inserting apparatus as defined in claim 16 wherein the acute angle between said leading edge and the plane of the foredges is approximately forty five degrees, said leading edge extending downwardly away from the book as said knife assembly first contacts and enters the book as said selected location.

20. The ribbon inserting apparatus defined in claim 19 wherein said ribbon inserting means is disposed rearwardly of said leading edge of said knife assembly.

* * * * *